US006604957B2

(12) United States Patent
Comini

(10) Patent No.: US 6,604,957 B2
(45) Date of Patent: Aug. 12, 2003

(54) FIELD-ATTACHABLE CONNECTOR

(75) Inventor: Riccardo Comini, Milan (IT)

(73) Assignee: Woodhead Industries, Inc., Deerfield, IL (US)

( * ) Notice: Subject to any disclaimer, the term of this patent is extended or adjusted under 35 U.S.C. 154(b) by 0 days.

(21) Appl. No.: 10/124,680

(22) Filed: Apr. 17, 2002

(65) Prior Publication Data

US 2002/0182927 A1 Dec. 5, 2002

Related U.S. Application Data

(60) Provisional application No. 60/285,266, filed on Apr. 20, 2001.

(51) Int. Cl.[7] ..... H01R 4/24
(52) U.S. Cl. ..... 439/417
(58) Field of Search ..... 439/417, 411, 439/412

(56) References Cited

U.S. PATENT DOCUMENTS

| | | | | | |
|---|---|---|---|---|---|
| 5,281,163 | A | | 1/1994 | Knox et al. | 439/404 |
| 5,295,857 | A | | 3/1994 | Toly | 439/395 |
| 5,549,484 | A | | 8/1996 | Chen | 439/417 |
| 5,551,889 | A | | 9/1996 | Kozel et al. | 439/404 |
| 5,620,332 | A | * | 4/1997 | Gerke et al. | 439/417 |
| 5,626,490 | A | | 5/1997 | Pitts et al. | 439/404 |
| 5,782,652 | A | | 7/1998 | Feher et al. | 439/417 |
| 5,860,829 | A | * | 1/1999 | Hower et al. | 439/417 |
| 5,989,057 | A | * | 11/1999 | Gerke et al. | 439/417 |
| 6,120,317 | A | | 9/2000 | Miquet | 439/417 |
| 6,139,353 | A | * | 10/2000 | Muz | 439/417 |
| 6,254,421 | B1 | * | 7/2001 | Denovich et al. | 439/417 |
| 6,273,746 | B1 | * | 8/2001 | Seko et al. | 439/417 |
| 6,287,149 | B1 | * | 9/2001 | Elkhatib et al. | 439/417 |

* cited by examiner

*Primary Examiner*—Gary Paumen
(74) *Attorney, Agent, or Firm*—Emrich & Dithmar

(57) ABSTRACT

A field-attachable contact assembly includes a contact having a seat portion which includes a wire-receiving aperture having a generally circular portion for receiving an insulated wire and a narrowing V-shaped portion for establishing an insulation displacement connection with the wire. A pusher includes a slot for receiving the seat of the contact, and an aperture which, when aligned with the circular portion of the contact opening, receives the wire. The pusher is then pushed onto the contact to establish an IDC electrical connection between the contact and the wire.

8 Claims, 6 Drawing Sheets

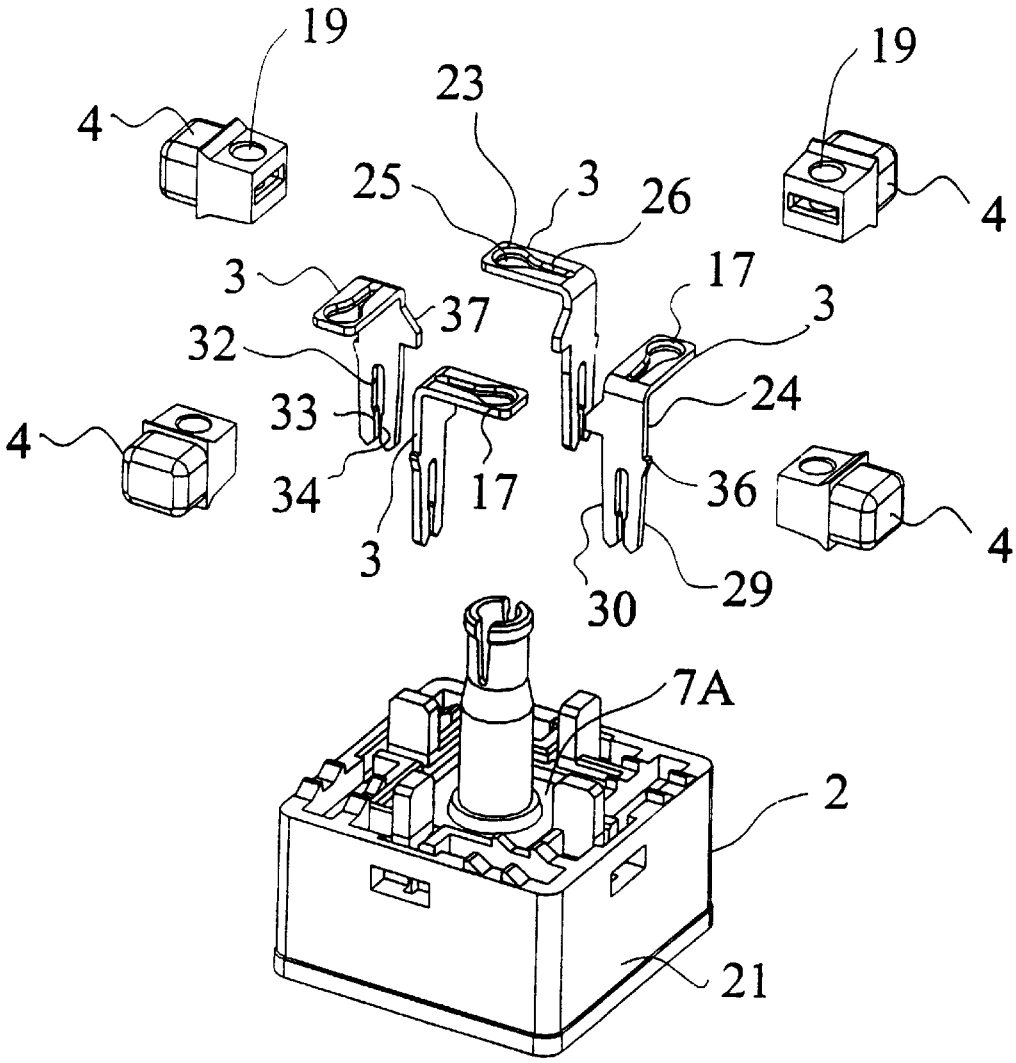
FIG.2
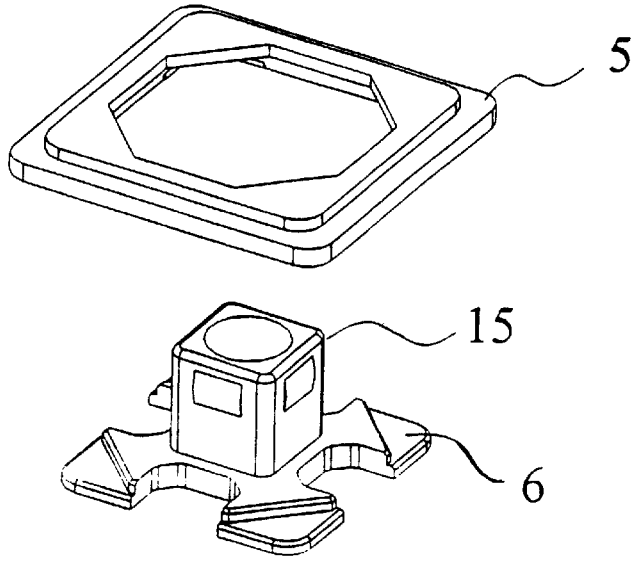

FIELD-ATTACHABLE CONNECTOR

RELATED APPLICATION

This application claims the benefit of the filing date of co-pending U.S. Provisional Application No. 60/285,266 filed Apr. 20, 2001.

FIELD OF THE INVENTION

The present invention relates to electrical connectors of the type used in manufacturing automation systems. In particular, the invention relates to improvements in a DIN connector for mounting to the body of a solenoid while providing electrical connectors for operating the solenoid. Such connectors are currently widely used. They comply with internationally recognized standards, as persons skilled in the art will readily appreciate.

BACKGROUND AND SUMMARY OF THE INVENTION

Prior art devices adapted for establishing the necessary electrical connections in the field (that is, at the site where the connection to a solenoid or other electromechanical actuator is required) have employed reliable but cumbersome techniques for establishing electrical connections. For example, set screws were used in combination with apertured connector blocks. It requires that the wires be stripped (typically there are four incoming wires in a feed cable); and the stripped ends are placed in associated connector blocks and the set screws then tightened. As persons skilled in the art will readily appreciate, connectors of this type are fairly small, and field conditions for establishing connections are not always desirable, resulting in a time-consuming and sometimes difficult conditions under which to establish a connection. Another problem with prior art connectors of this type involves a gasket associated with the connector. The connector, once the connections with the feed cable are made, is assembled by means of a screw to a base mounted to the body of the solenoid. The fixed base mounts the prongs forming the male connector receiving the instant connector, which is a female. A flexible gasket is interposed between the exterior housing the connector and the base on the solenoid. Over time, and particularly in use conditions where the connector is exposed to oils or other corrosive materials, the gasket becomes soiled or damaged, and it is desired to replace the gasket. This is sometimes desired merely in the course of normal maintenance or repair, whether the gasket is damaged or not. Thus, some connector manufacturers provide gaskets which are removable from the housing of the connector. If the gasket is permanently mounted to the housing, it is difficult or time-consuming to replace it, and some customers desire removable gaskets. When the connector comes with a removable gasket, it sometimes becomes deformed during extended use, and during repairs or maintenance it may be dropped or lost.

The present invention solves the problem of establishing the necessary electrical connections in the field by using connection techniques involving displacing the insulation of the wire and establishing the connection without having to strip the end of the wire of its insulating jacket. The particular structure for establishing the insulation displacement connection (IDC) includes the use of a specially shaped contact seated in the contact holder of the connector body and including a laterally extending portion which provides an aperture for receiving the wire and converging, sharp edges for piercing the insulation and contacting the wire to establish the connection. To establish the contact, a pusher member is aligned with the horizontal portion of an associated contact, and the unstripped end of the wire is aligned with a vertical aperture in the pusher member as well as the enlarged portion of the cutting slot in the contact. The pusher member is then pushed onto the contact to move the wire into the cutting portion of the contact aperture, thereby establishing the connection. The pusher member is then secured to the housing by means of a barb, maintaining the established contact. This is repeated for each of the four wires.

The base of the contact holder is provided with a generally rectangular cavity forming a receptacle which is sized to receive a retainer member. The gasket is removably held in place by the retainer member in the form of a pedestal having a central projection which is dimensioned to provide an interference fit into the receptacle formed by the rectangular aperture in the base of the contact holder. This facilitates replacement of the gasket as desired.

Other features and advantages of the present invention will be apparent to persons skilled in the art from the following detailed disclosure of the exemplary embodiment accompanied by the attached drawing wherein identical reference numerals will refer to like parts in the various views.

BRIEF DESCRIPTION OF THE DRAWING

FIG. 2 is a perspective view of the components of a connector in exploded relation, taken from the top and one side of the connector;

DETAILED DESCRIPTION OF THE ILLUSTRATED EMBODIMENT

Figure 1:
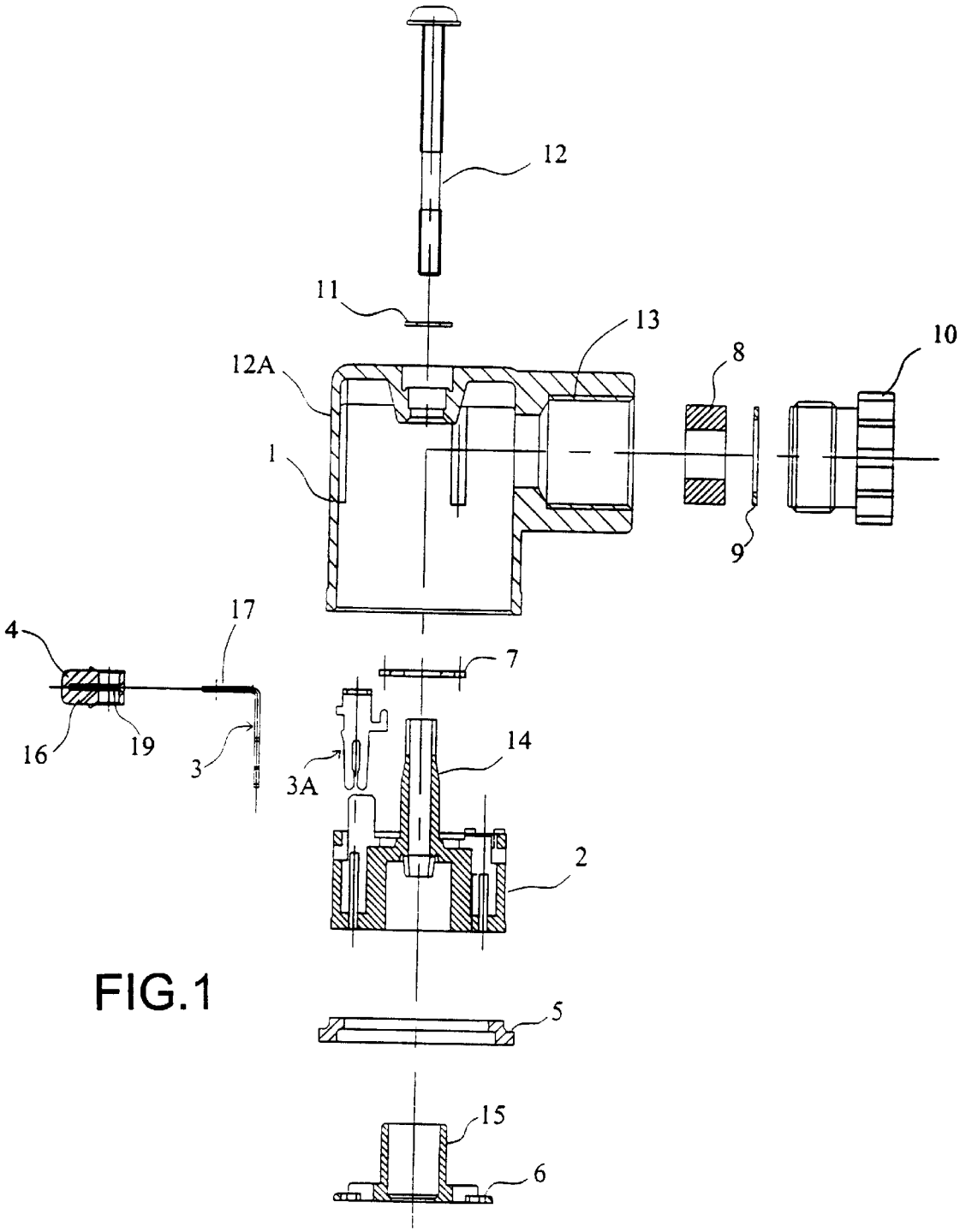
FIG. 1 is a side elevational view of the connector components, shown in vertical section and in exploded relation.

Referring first to FIG. 1, reference numeral 1 identifies an exterior housing having a generally rectangular outer wall portion 12A and a generally cylindrical wire attaching portion 13 extending to the side. The wire attaching portion 13 has a central bore or aperture for receiving a cable feed (typically four insulated wires in a molded sheath or jacket) to be connected to the connector, as persons skilled in the art will appreciate. Further, a flexible seal 8, washer 9 and threaded compression nut 10 are placed around the cable and fastened to the interior threads of the cylindrical wire attaching portion 13 of the connector housing to provide strain relief and a seal for the cable.

The rectangular outer wall portion 12A of the housing 1 receives a contact holder 2 to be described in more detail below. The contact holder 2 includes a central, upright, hollow stem 14 about which may be placed an electronic circuit board (PCB) 7 in the area designated 7A in FIG. 4. The PCB 7 may include indicators or circuit components according to the desire of the customer. The stem 14 receives a retainer screw 12 which extends through the housing 1, stem 14 of contact holder 2, gasket 5 and retainer 6 to secure the assembly to the mounting base fixed to the body of the solenoid, according to existing practice.

The contact holder 2 receives a plurality of electrical contacts (four in the case of the illustrated embodiment as is typically the case), two of which are shown in FIG. 1 and designated respectively 3 and 3A. Contact 3 is seen in side view. All contacts 3 are the same, having the shape of an inverted "L" including an upright portion or "leg" and a horizontal portion or "seat." The contact 3A has the horizontal seat portion of the contact facing the observer, as will be appreciated from further description. Each contact has associated with it a pusher unit designated 4 in FIG. 1. Each pusher unit has a horizontal slot 16 for receiving the horizontal seat portion (designated 17 in FIG. 1 for contact 3), of an associated contact and an upright wire-receiving bore or aperture 19, the purpose of which will be described further below.

Turning now to FIG. 2, housing 1 is not shown, and the other components of the connector are shown in exploded relation. It will be seen that the contact holder 2 has a generally square outer wall 21, and it is adapted to receive four individual contacts, each designated 3 because they are identical. Associated with each contact is a pusher 4, in the form of an end cap. All of the pushers may also be identical. The pushers 4 are preferably made of any suitable insulating, molded, rigid material.

Figure 3:
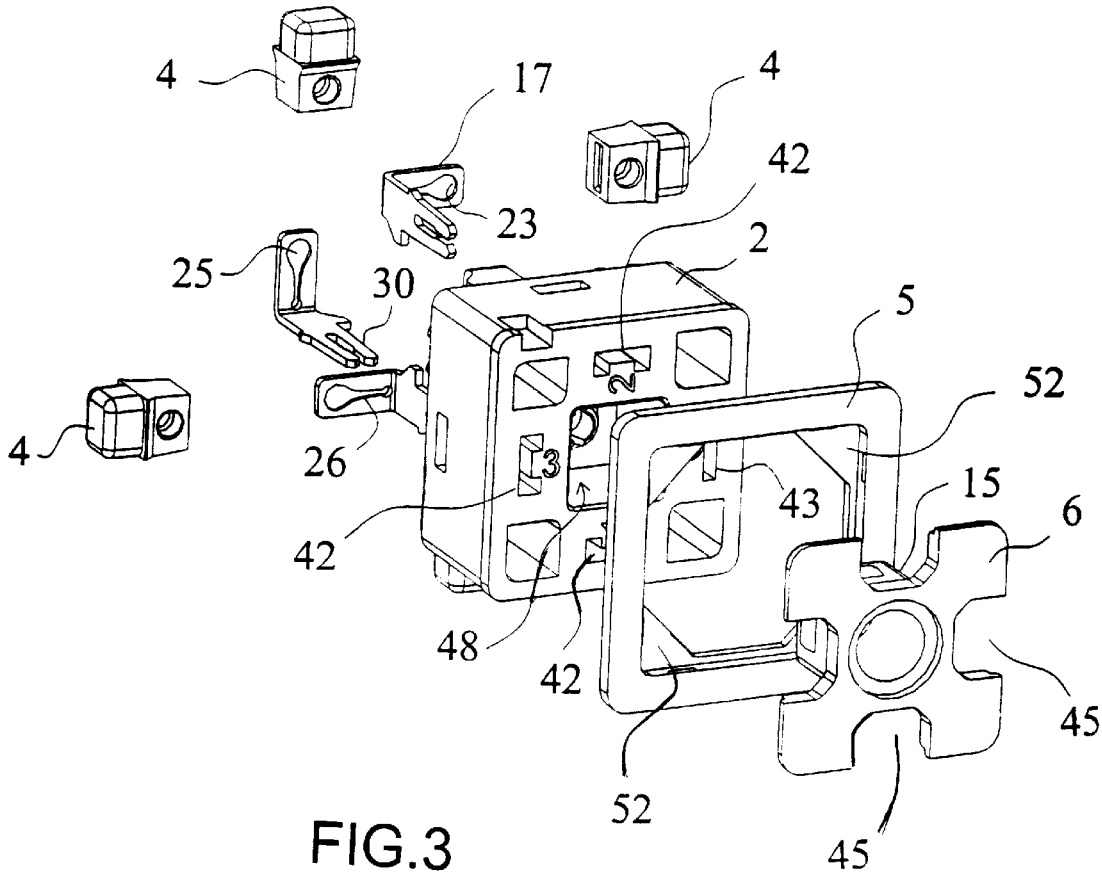
FIG. 3 is a lower, side perspective view of the elements of FIG. 2, again in exploded relation.

Turning now to FIGS. 2 and 3, contacts 3 each include the previously mentioned horizontal seat portion 17, and an upright leg portion 24. The horizontal seat 17 includes an aperture or slot 23 in the general form of a teardrop, having an enlarged distal opening 25 sized to receive a wire including its outer jacket, and a narrowing, V-shaped portion designated 26. The converging edges of the narrowing opening 26 are sharpened so as to cut or pierce the insulation (without removing it) when the wire is translated by its associated pusher 4 from the wire-receiving aperture 23 to the narrowing IDC slot 26.

The upright leg 24 of the contact 3 includes left and right stakes 29, 30 which are separated to define an upright, elongated opening 32 for receiving a blade or contact element of a mating male contact mounted on the solenoid housing which extends above the mounting base on which the instant connector (which may be considered a female connector) is mounted by means of the retainer screw 12. It will be observed from FIG. 2 that the opposing, distal edges of the stakes 29, 30 extend inwardly to provide contact pads designated respectively 33 and 34 for contacting the male contact elements.

The lateral edges of the upright leg 24 of the contact include oppositely facing barbs. A smaller barb 36 is located on the outer side edge of the contact, and has its engaging or limit surface facing upwardly; and a larger barb 37 is located on the inboard edge of the upright portion 24 and has its limit surface facing downwardly. The terms "outward," "outboard" and "inboard" are used in reference to the vertical center of the contact holder 2. The purpose of these barbs is to prevent the contact from being separated from the contact holder once inserted, while permitting limited vertical movement of the contact.

Figure 5:
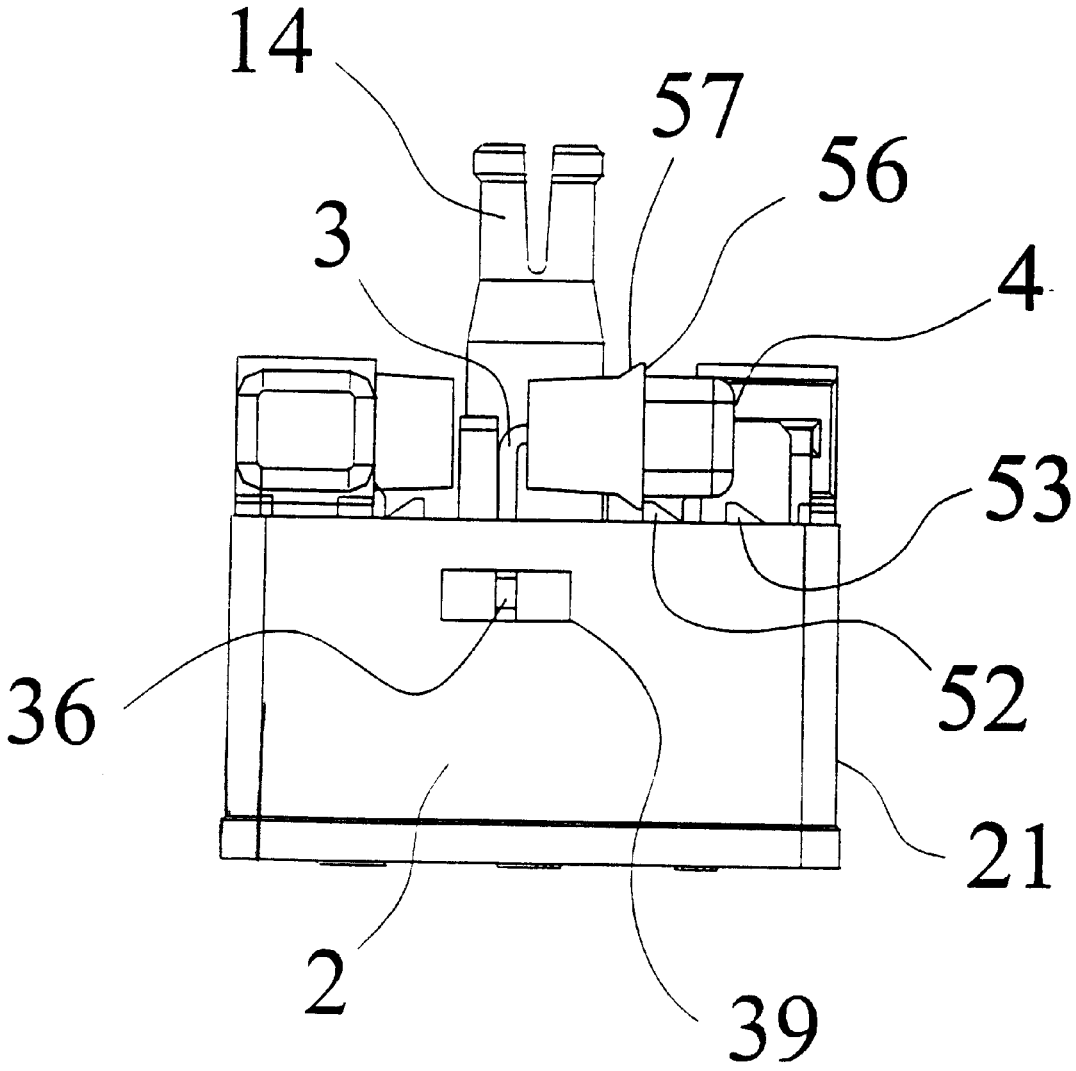
FIG. 5 is a side elevational view of the contact holder of the connector.

Turning briefly to FIG. 5, the outboard barb 36 of the contact 3 extends into a generally rectangular opening 39 in the sidewall 21 of the contact holder 2, and the limit surface of the barb 36 engages the upper wall of the opening 39 to prevent removal of the contact. A similar horizontal surface in the contact holder, seen in FIG. 1, limits the downward movement of the contact 3 within the contact holder 2, by engaging the limit surface of the larger, inner barb 37. This permits limited movement of the associated contact within the contact holder, but prevents removal.

Specifically referring to FIG. 3 which is a lower perspective view of the device, it will be seen that the bottom of the contact holder 2 includes three C-shaped slots 42 and a straight slot 43 for receiving the contacts of the associated male connector. The blades of the male connector extend through openings 45 in the retainer 6 which are aligned with the slots 42, 43 to permit assembly of the instant connector to its associated male connector (not seen in the drawing).

Still referring to FIG. 3, the center of the bottom of the contact holder 2 includes a generally rectangular receptacle 48 which receives in press fit a corresponding hub 15 (see also FIG. 2) of the retainer member 6. The hub 15 extends through the central opening of the gasket 5. The bottom of the retainer 6 is flat and it is received in a corresponding recess 51 in the gasket 5, the corners of which include triangular gusset members 52 which act to seat and hold the gasket in place when the retainer 6 is assembled to the contact holder 2, but which also release the gasket when the retainer is removed from the contact holder.

Figure 6:
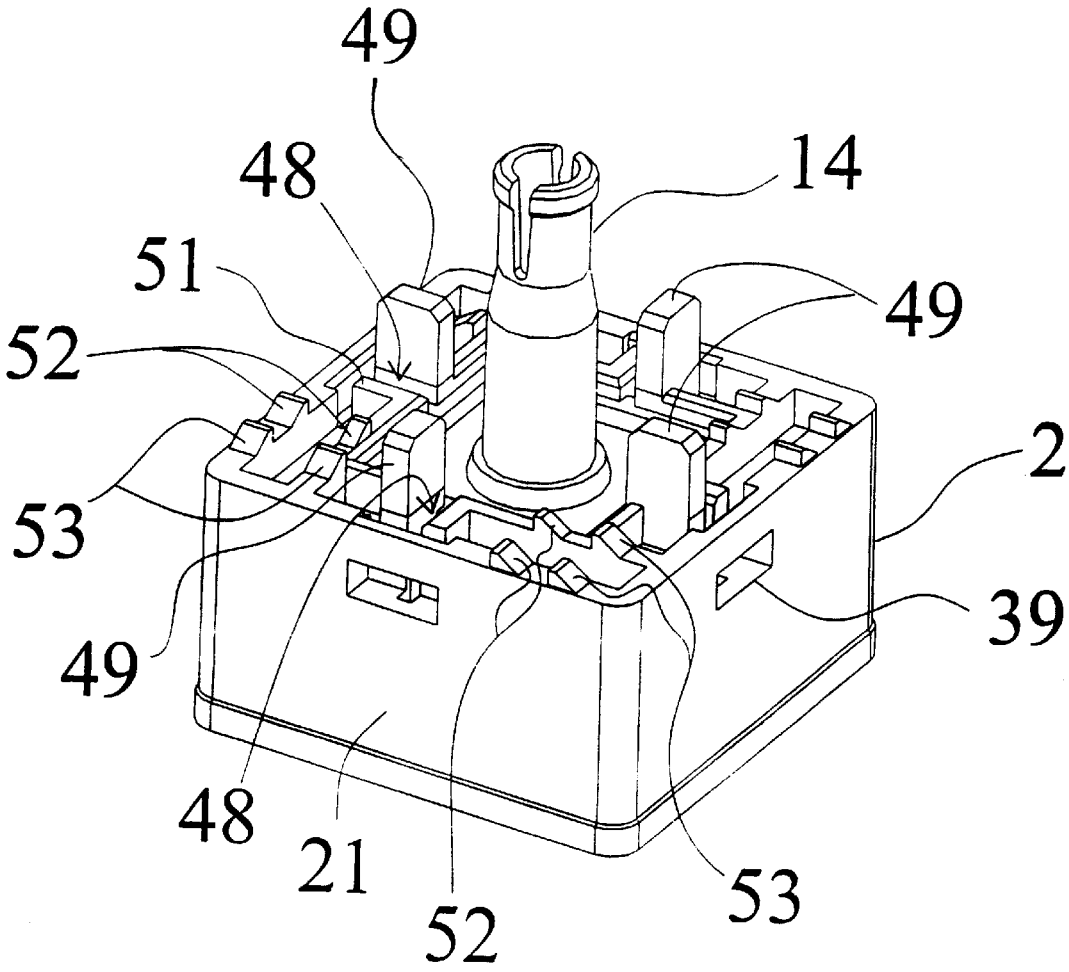
FIG. 6 is an upper perspective view of the contact holder of the connector.

Turning now to FIG. 6, the contact holder 2 defines a similar receptacle for each of the contacts 3 (which are not shown in FIG. 6 for clarity), and only one such receptacle need be described in order to understand all the receptacles. A vertical slot or opening 48 is provided adjacent the upper left sidewall, and a vertical backer or support member 49 is located immediately adjacent the inlet to the vertical slot 48. The backer member 49 defines one surface of the slot 48 and assists in supporting the upright leg 24 of a contact 3 received in the slot 48. The horizontal seat portion 17 of a contact extends toward the lower left hand corner of the contact housing 2 in FIG. 6 and rests on an upper support edge 51. Two pairs of stops designated respectively 52 (one pair) and 53 (the second pair) are formed in the upper surface of the contact holder to secure the associated IDC pusher when it is assembled to its associated contact, as will now be described. It will be seen from FIG. 6 that each of the contacts is received in structure similar to that which has just been described for the contact to be received in slot 48.

Figure 4:
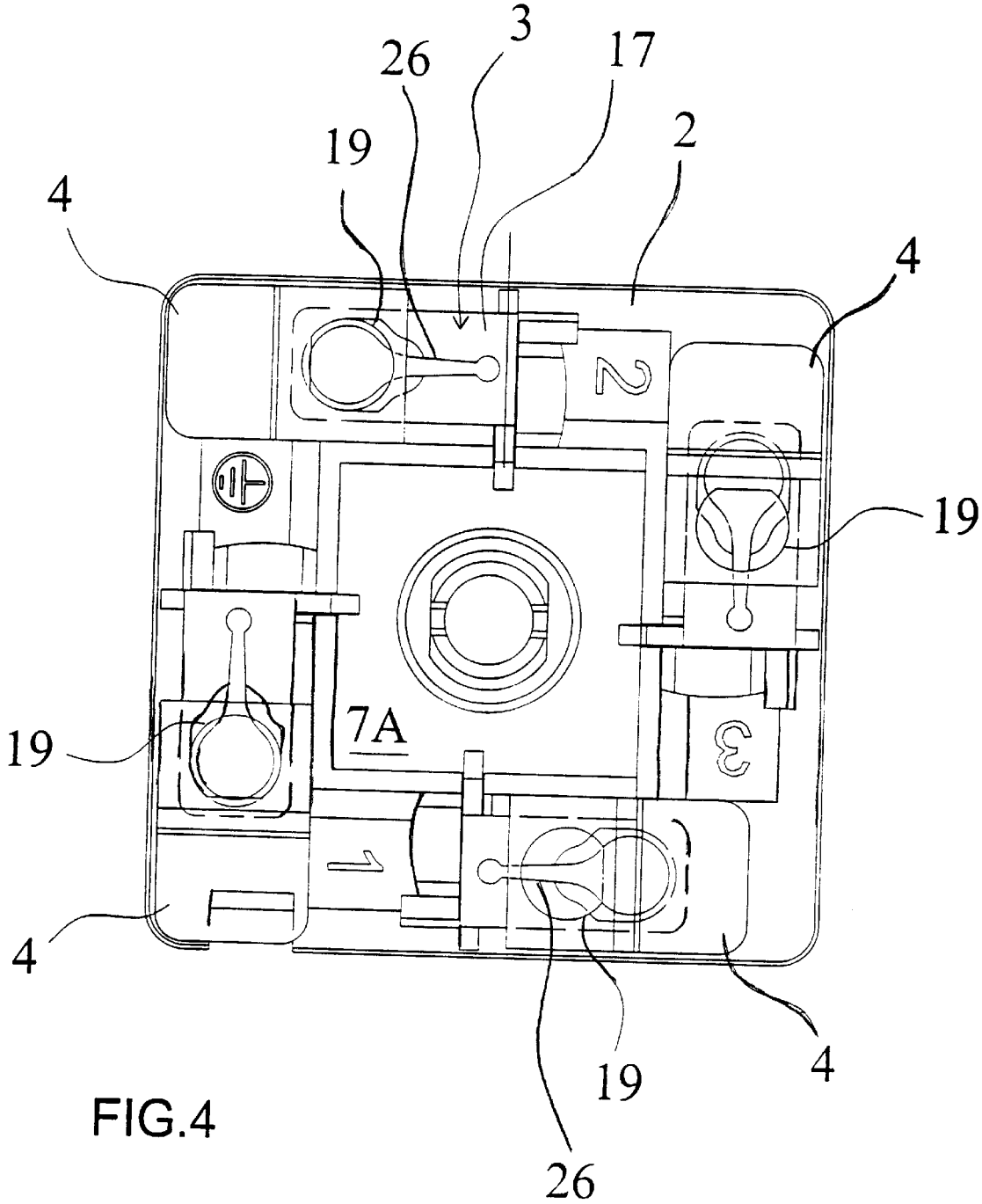
FIG. 4 is a top view of the connector with the casing removed, showing the contact holder and other components in assembled relation.

To establish contact with the wires of a feed cable, each of the wires has a distal end bent to assume a vertical disposition; and the four wires are located generally to align with an associated aperture 19 of an IDC pusher 4, as seen in FIG. 4, which is a top view, the bent wire ends are aligned with the apertures 19 and placed downward (into the plane of the page of FIG. 4).

Since the operation of each contact 3 and its associated IDC pusher 4 is the same for all four contacts, only one need be described in further detail. Still referring to FIG. 4, the contact 3 is assembled to the contact holder 2. The pusher 4 is assembled loosely to the horizontal seat portion 17 of the contact 3, with the aperture 19 of the pusher aligned with the larger, wire-receiving portion 25 of the aperture 23 of the contact 3, as seen in FIG. 4. The down-turned end of the associated wire is then placed through the aligned openings in the pusher and contact; and the pusher 4 is urged laterally onto the seat 17 of the contact (i.e., to the right in FIG. 4 for the contact at the top), thereby causing the associated wire to be moved through the narrowing portion 26 of the IDC slot of the contact 3, causing the sharpened edges of the slot to penetrate the insulation of the wire and establish direct electrical contact between the central conductor of the wire and the contact 3.

In FIG. 4, the pusher members 4 for the contacts on the top and left sides are positioned to receive a wire—that is, the round opening 19 of the pusher 4 is aligned with the round wire-receiving portion 25 of the contact 3. The two contacts on the lower and right sides of FIG. 4 have had the pusher pushed onto the contact to effect an IDC connection between the contact and the wire. That is, the opening 19 of the pusher is aligned with the narrowing V-shaped portion 26 of the aperture 23 of the contact.

Referring to FIG. 5, the pusher 4 includes a peripheral stop or limit surface 56 the front of which is ramped as at 57 to facilitate riding over the barbs 53, 52, but locking the pusher in place when the shoulder 56 engages the upright surface of the barb 52, thereby securing the wire (not seen in FIG. 5) in firm contact and electrical continuity with the contact 3. The same operation and structure is associated for each of the plurality of wires desired to be connected to the connector.

Having thus disclosed in detail an embodiment of the invention, persons skilled in the art will be able to modify the structure illustrated and substitute equivalent elements for those disclosed; and it is, therefore, intended that all such substitutions and equivalents be covered as they are embraced within the scope of the appended claims.

I claim:

1. A connector assembly attachable to a cable having a plurality of insulated wires and adapted to mount to a body having a mating connector with a plurality of male connector blades comprising:

a housing having an attaching portion receiving said cable in sealing relation;

a contact holder having a plurality of receptacles, one for each of said wires of said cable;

a contact received in each receptacle and comprising a seating portion and an upright portion inclined relative to said seating portion; said seating portion defining a wire-receiving aperture having a V-shaped slot with insulation piercing edges; and a pusher element for each contact, each pusher element having a first aperture adapted to receive an associated wire of said cable and a slot extending generally transverse of said first aperture and in communication therewith for receiving a distal end of a seating portion of an associated contact, whereby a wire may be placed through a first aperture of a pusher element and a wire-receiving aperture of an associated contact and said pusher element is moved onto said seating portion of said associated contact to establish an insulation displacement connection between said wire and its associated contact.

2. The apparatus of claim 1 wherein said upright portion of each of said contacts further includes a body portion and first and second legs depending from said body portion, said first and second legs being spaced apart to receive a blade contact of a mating connector and to establish electrical continuity therewith.

3. The apparatus of claim 2 wherein each of said legs of each contact includes a contact pad in opposing relation to a contact pad on an adjacent leg for contacting said blade contact of said mating connector.

4. The apparatus of claim 3 wherein said seating portion of each of said contacts includes a generally circular opening defining said wire-receiving aperture and in communication with the associated V-shaped slot whereby a wire may be received in said generally circular opening and thence pushed into said V-shaped slot for establishing electrical continuity.

5. The apparatus of claim 4 wherein each of said pusher elements further includes at least one latch surface extending outwardly of the direction of movement of said pusher in establishing an insulation displacement connection, and wherein said contact holder includes at least one corresponding limit surface adjacent each receptacle for engaging and securing said latch surface of an associated pusher to inhibit removal of said wire from said V-shaped slot.

6. The apparatus of claim 2 wherein said upright portion of each of said contacts includes first and second barbs having respective contact surfaces facing in opposed directions and spaced apart along a direction of extension of said legs thereof, said contact holder including first and second surfaces arranged to be adjacent said first and second contact surfaces of said first and second barbs respectively of an associated contact.

7. The apparatus of claim 6 further comprising a housing including a wire-receiving portion, said housing receiving said contact holder, said wire-receiving portion adapted to receive the cable including a plurality of insulated wires; and a compression seal for sealing a cable within said wire-receiving portion of said housing.

8. The apparatus of claim 7 wherein said contact holder includes a bottom portion defining a generally rectilinear cavity communicating with said bottom portion; and further comprising a peripheral gasket for sealing said bottom portion to a mounting surface; and a retainer including a hub adapted to be received and frictionally held in said cavity of said contact holder.

* * * * *